United States Patent [19]

Smith, Jr.

[11] 3,988,200

[45] Oct. 26, 1976

[54] SYSTEM FOR HEAT-EXCHANGE OF HEAT TRANSFER LIQUID WITH STEAM IN PAPERMAKING INSTALLATIONS

[75] Inventor: Horace L. Smith, Jr., Richmond, Va.

[73] Assignee: Smitherm Industries, Inc., Richmond, Va.

[22] Filed: Jan. 20, 1976

[21] Appl. No.: 650,780

Related U.S. Application Data

[63] Continuation-in-part of Ser. No. 622,617, Oct. 15, 1975.

[52] U.S. Cl. ..... 162/290; 34/119; 162/359; 165/47

[51] Int. Cl.[2] ..... D21F 5/06

[58] Field of Search ..... 162/206, 207, 290, 359; 34/41, 119, 124, 125, 152, DIG. 20; 165/47, 89, 90

[56] References Cited

UNITED STATES PATENTS

| | | | |
|---|---|---|---|
| 2,811,787 | 11/1957 | Clements | 162/290 X |
| 3,236,292 | 2/1966 | Smith, Jr. | 165/103 X |

*Primary Examiner*—S. Leon Bashore
*Assistant Examiner*—Richard V. Fisher
*Attorney, Agent, or Firm*—Strauch, Nolan, Neale, Nies & Kurz

[57] ABSTRACT

Installations and methods for making paper in which high boiling point liquids are employed to heat the dryers in a dryer section and in which the heat transfer liquid is heated by mill steam.

3 Claims, 2 Drawing Figures

Figure 1:
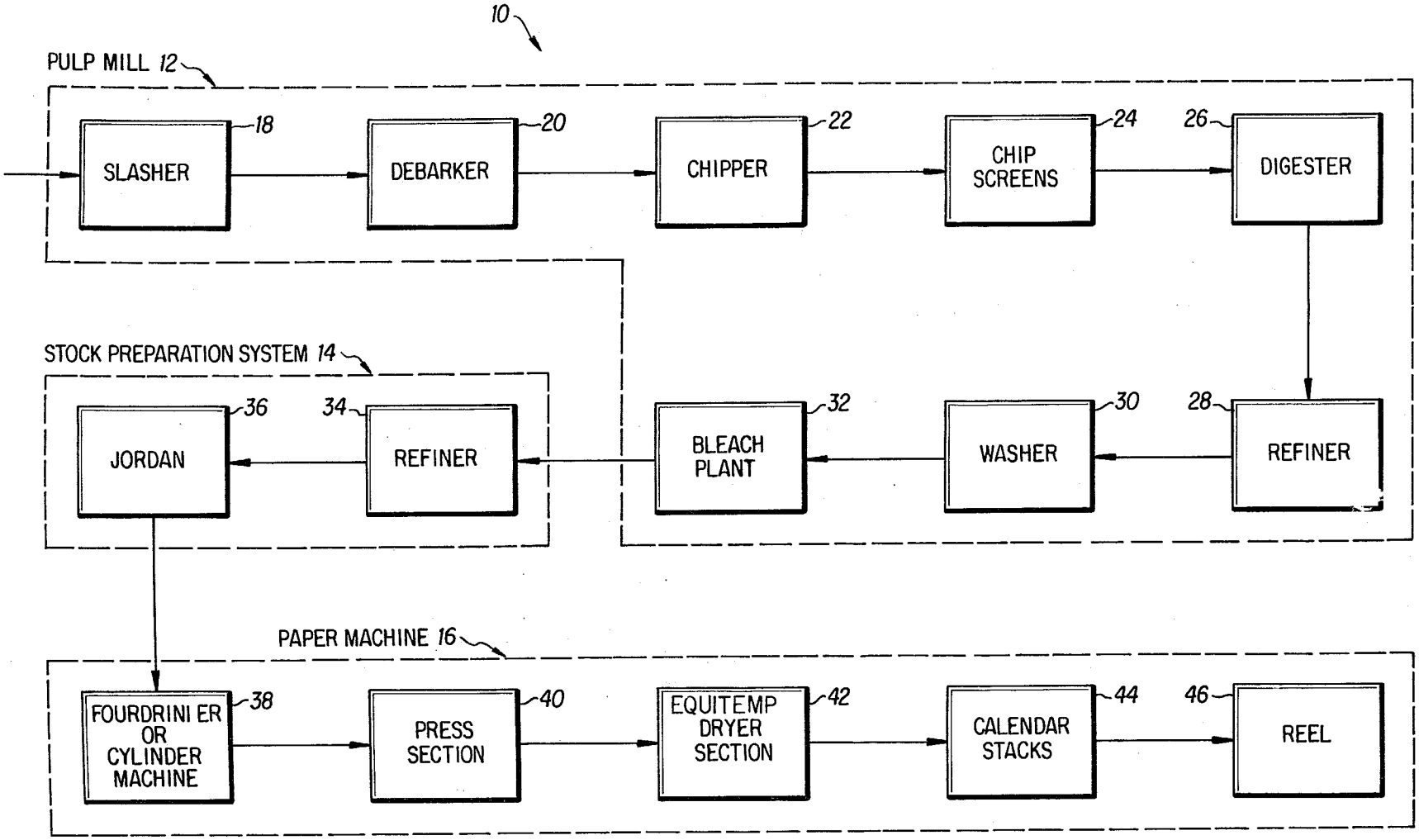

SYSTEM FOR HEAT-EXCHANGE OF HEAT TRANSFER LIQUID WITH STEAM IN PAPERMAKING INSTALLATIONS

PAPERMAKING INSTALLATIONS AND METHODS (I)

This application is a continuation-in-part of application No. 622,617 filed Oct. 15, 1975.

The present invention relates to papermaking and, more particularly, to novel, improved methods and apparatus for supplying heat to the dryer section appended to a papermaking machine.

The term "paper" is used herein in the same generic sense as it is in the papermaking industry. Products embraced by this term include but are not limited to: newsprint; uncoated, ground wood paper; coated printing and converting papers; uncoated book paper; writing and related papers; bleached bristols; unbleached kraft packaging and industrial converting papers; other packaging and industrial converting papers; special industrial papers; tissue paper; unbleached kraft and industrial converting paperboard; bleached packaging and industrial converting paperboard; semichemical paperboard; combination furnish paperboard; wet machine board; and construction paper and board.

Large quantities of steam are consumed in making paper, especially in the making and preparation of the pulp which is converted into a web, dried, and calendared to complete the manufacturing process. In a sulphite pulp mill alone, for example, steam may be employed in presteaming and digesting the wood chips from which the pulp is made, in the preparation of the liquor in which the chips are digested, in recovering chemicals from the digestion process, and in generating electricity for operating process machinery, for example.

Modern steam generators are highly efficient pieces of equipment; and I have now discovered that advantage can be taken of this and the large capacities in which such equipment is or can be made available in drying the product made in typical mills.

Specifically, in the conventional paper mill steam is employed to heat the 100 or more rotary dryers in the dryer section. Parent application No. 622,617 discloses that substantial reductions in the cost of drying the paper can be made and a better product produced by substituting liquid heated, equitemp dryers for those of conventional character.

It is of course necessary in an installation as just described to provide a way of heating the heat transfer liquid.

I have now discovered that steam generated in the mill can be used to advantage for this purpose. In particular the economics of heating the heat transfer liquid in this manner are often favorable because of the above-noted efficiency of available steam generators, because heat exchangers in which the energy can be efficiently transferred from the steam to the heat transfer liquid are also available, and because the scheme in question eliminates the necessity of providing a separately fired unit for heating the heat transfer liquid.

A variety of heat exchange liquids which can be employed in the manner and for the purpose just described are available. Among these are Therminol heat transfer fluids, proprietary products of Monsanto Chemical Company, which may be used at temperatures as high as 800° F. Other suitable heat transfer liquids are marketed by the Dow Chemical Company under the name Dowtherm and by Chemische Werke Huls AG under the name Marlotherm.

The heat exchanger in which the transfer of heat is made can be of the conventional shell and tube type. Steam can be diverted from the mill steam line through the heat exchanger and the condensate returned to the main condensate return line.

It will be apparent to the reader from the foregoing that one important and primary object of the invention is to lower the cost of making paper.

A related and also important object of the invention resides in reducing the cost of operating the dryer section of a papermaking machine.

An also related and important object of the invention resides in the provision of novel, improved dryer sections in which a high boiling point liquid is used to heat the dryers and in which the heat transfer liquid is indirectly heated by steam.

Figure 2:
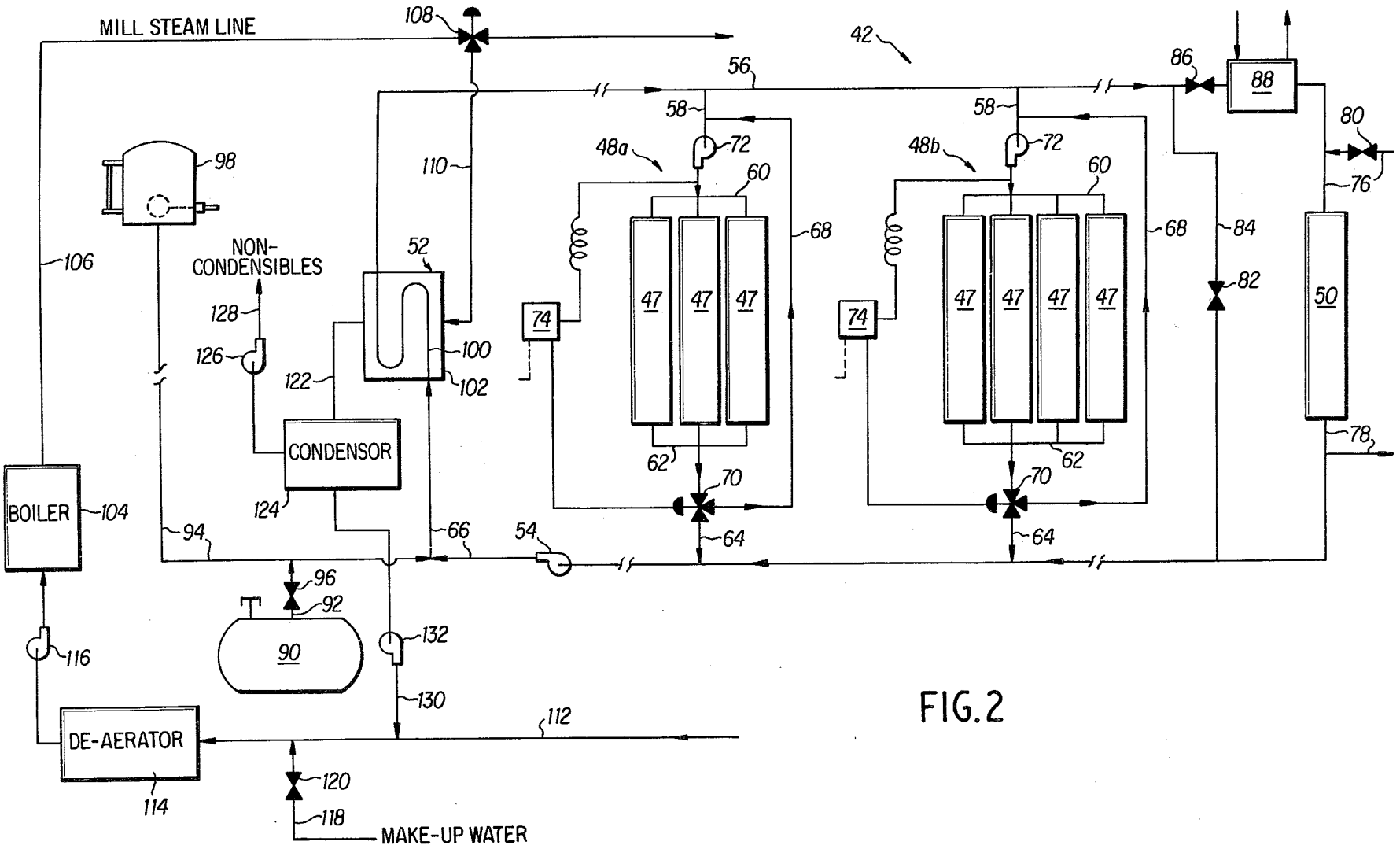

Other important objects and features and additional advantages of my invention will become apparent from the appended claims and as the ensuing detailed description and discussion proceeds in conjunction with the accompanying drawing, in which:

FIG. 1 shows in block diagram form the major units of the paper mill of the present invention; and FIG. 2 is a schematic illustration of a system for supplying a heat transfer liquid to the dryer section of a papermaking machine in accord with the principles of the present invention.

Referring now to the drawing, FIG. 1 depicts schematically a paper mill 10 composed of a pulp mill 12, a stock preparation system 14, and a paper machine 16.

The exemplary pulp mill shown in FIG. 1 includes a slasher 18 for cutting the pulp logs to a selected length, a debarker 20 for removing the bark from the logs, a chipper 22 which converts the logs into small chips of wood, and chip screens 24 where oversized pieces are removed. From the screens the chips proceed through a digester 26 and a refiner 28 where they are first chemically and then mechanically treated to liberate cellulose fibers. Chemical contaminants are removed from the fibers by a washer 30, and the fibers then proceed to a bleach plant 32 where the fibers are decolorized.

From the bleach plant the clean, decolorized pulp passes to stock preparation system 14 where it is mechanically treated as in a refiner 34 and a Jordan 36 and also treated with various chemicals and fillers to make the fibers suitable for forming into a sheet or web of paper.

The stock flows from stock preparation system 14 to paper machine 16 which includes a Fourdinier, cylinder or other machine 38 where the fibers in the pulp are formed into an endless sheet or web (which may be 30 feet wide or wider in a modern installation) at a rate of up to 5,000 feet per minute or higher.

This sheet proceeds through a press section 40 where the wet web (which may be up to 85 percent water) is squeezed and/or subjected to a vacuum to remove as much water as practical as mechanical removal is much less costly than removing the water by evaporation.

From press section 40 the paper (now having a moisture content of one to three pounds per pound of paper) passes through a dryer section 42 in accord with the principles of the present invention where the web is dried to a moisture content of 6 to 10 percent; i.e., to a moisture content of 0.1 lb per lb of paper or less.

The dried paper is passed through calendar stacks 44 to improve the quality of the paper by compacting it and by smoothing and otherwise changing its surface properties through pressure and friction.

After passing through the calendar stacks, the paper is wound into a roll by a reel 46 to complete the manufacturing process except for trimming the edges of the web, slitting the paper into strips of a selected width, and rewinding the strips.

Referring now to FIG. 2, the novel dryer section 42 of the present invention includes liquid heated, rotary dryers 47 divided into groups in which the operating temperatures can be independently controlled to optimize the dryer operation (two such groups are shown in FIG. 2 and identified by reference characters 48*a* and 48*b*).

Dryer section 42 also includes a sweat roll 50 for adjusting the surface moisture content of the paper to the optimum level for calendaring in calendar stacks 44.

The dryers 47 and sweat roll 50 are of the equitemp type and preferably of the construction shown in parent application No. 622,617 or in my prior U.S. Pat. Nos. 3,177,932 issued Apr. 13, 1965, for DRUM TYPE HEAT TRANSFER APPARATUS; 3,181,605 issued May 4, 1965, for UNIFORMLY HEATED ROTARY DRUM; and 3,228,462 issued Jan. 11, 1966, for HEAT EXCHANGE APPARATUS, which are hereby incorporated herein by reference.

Equitemp rotary dryers have concentric inner and outer shells between which a heat exchange liquid is circulated to heat the outer shell. Typically, the heat exchange liquid is circulated in counterflow fashion through internested, labyrinthic flow channels defined by partitions between the inner and outer shells.

The heat transfer liquid for the paper dryers 47 is heated in unit 52 which is preferably a shell and tube type heat exchanger.

A pump 54 circulates the heated liquid from unit 52 through main supply conduit 56, branch conduits 58, and supply manifold 60 to the dryers 47 in dryer section 42. After flowing through the dryers, the liquid is discharged through manifolds 62 into branch conduits 64 and is recirculated through these and main return conduit 66 to the heating unit.

As indicated above, the different groups of dryers can be maintained at different temperatures. For example, the three paper dryers 47 in the first dryer group or zone 48*a* will typically be operated at temperatures comparable to those of the dryers in a conventional installation. Otherwise, moisture may be evaporated at such a high rate as to blow the paper away from the dryers.

The remaining paper dryers 47 will, however, typically be operated at temperatures as much as 250° F or more above the practical maximum of steam heated, rotary dryers. The result is a significant increase in efficiency and a corresponding reduction in cost.

Independent control over the different groups or zones is furnished by a recirculation conduit 68 connected between the branch return and supply conduits 64 and 58 in each zone and a three-way diverting valve 70 discharging into the conduits 64 and 68 of the zone.

A pump 72 in each dryer group or zone 48 circulates the liquid through the dryers and conduits in that zone.

Each valve 70 is controlled by a conventional temperature controller 74. The controller has a sensor (not shown) that responds to the temperature of the liquid circulated to the paper dryers of the zone by its pump 72.

If the dryers in a particular group become too hot, the controller 74 for that groups adjusts its valve 70 to divert relatively cool liquid through recirculation conduit 68 to the inlet side of pump 72. Recirculation continues until the temperature of the dryers drops to the wanted level. Then, temperature controller 74 repositions valve 70, decreasing the flow of liquid through recirculation conduit 68 and increasing the flow through branch return conduit 64. As a result, increased quantities of more highly heated heat transfer liquid are pumped from main supply conduit 56 through branch supply conduits 58 and into the dryers.

As indicated above, the novel dryer section 42 of the present invention will typically include a sweat roll 50 which may be of the same construction as the paper dryers 47. Typically, water from any convenient source will be employed as an operating liquid for the sweat dryer. As shown in FIG. 2, the water can be supplied to the sweat dryer through conduits 76 and then discharged from the sweat roll through conduits 78.

Alternatively, the same heat transfer liquid employed to operate the paper dryers may be used as the operating liquid for the sweat dryer. In this case, valve 80 in the water supply line is closed as is valve 82 in a bypass conduit 84 between main heat transfer liquid supply and return lines 56 and 66. Valve 86 in conduit 56 is then opened, permitting the heat transfer liquid to flow through a conventional heat exchanger 88 of the shell and tube or other appropriate type to reduce the temperature of the heat transfer liquid. From the heat exchanger the liquid flows sequentially through conduit 76, the sweat roll, and conduit 78 into main return conduit 66.

Referring still to FIG. 2, the heat transfer liquid system also includes a storage tank 90 connected to the main liquid return conduit 66 by conduits 92 and 94. The flow of liquid through these conduits into the liquid circulation system is regulated by a valve 96 in conduit 92.

An expansion tank 98 is connected into the heat transfer liquid circulation system by conduit 94. This tank accommodates expansion of the liquid, preventing abnormal pressure conditions from bursting conduits or other system components, and maintains a gravity head on the circulation system. This is described in detail in my prior U.S. Pat. No. 3,236,292 issued Feb. 22, 1966, for HIGH TEMPERATURE HEATING APPARATUS, which is hereby incorporated by reference herein.

It is a novel feature of the dryer section just described that the operating liquid for the dryers 47 is heated indirectly by steam rather than in a direct-fired unit as in my previously disclosed paper drying systems.

Specifically, as the heat transfer liquid circulates through the tube side 100 of heat exchanger 52, it is heated by steam flowing through the shell side 102. The steam is supplied from the paper mill boiler or steam generator 104. In particular, steam generated in boiler 104 flows in large quantity through mill steam line 106 to a variety of steam using units such as digester 26 and the liquor preparation and recovery systems associated with the digester, bleach plant 32, and the Fourdrinier or other web making machine 38. The steam for heat exchanger 52 is diverted from line 106 through a flow regulating, three-way valve 108 and a branch steam supply line 110 to the heat exchanger.

Condensate recovered from the various steam using units is circulated through a main condensate return line 112 and a deaerator 114 to boiler 104 by a feedwater pump 116. Make-up water is supplied through a line 118 in which a flow control valve 120 is interposed.

Condensate and steam discharged from the shell side of heat exchanger 52 flows through line 122 to a condenser 124 where the blow-through steam is condensed. Non-condensibles are removed as by a vacuum pump 126 connected to the condenser through line 128. The condensate is then pumped through a branch condensate return line 130 into main line 112 by pump 132 to complete the cycle.

This novel liquid heating arrangement is efficient and also has the advantage of eliminating a direct-fired heater for the liquid along with the controls and other ancillary equipment a direct-fired heater requires.

As the make-up and components of the steam generating system are conventional, they will not be described further herein. Furthermore, it will be appreciated by those conversant with the relevant arts that the steam generating system may include other components such as a water softener, feedwater heater, etc.; and these components have accordingly likewise not been described.

For the reasons just described and because they are in so far as relevant discussed in parent application No. 622,617, the other components of the dryer section such as the felts, felt dryers, etc. have not been illustrated in the drawing or discussed above.

It will of course be appreciated by those conversant with the arts to which the present invention is directed that advantage may be taken of the principles thereof without employing the particular structure described above. For example, steam for operating the unit in which the heat transfer liquid is heated may be taken off at a point other than the main steam line. Also, the discharge from this heat exchanger may be saturated steam, or even steam bearing some degree of superheat. In such applications, the steam can be employed in other operating units rather than being condensed and recirculated to the steam generator.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. In a papermaking installation: means for making a web of paper; web drying means which has an external surface that is adapted to be contacted by the web and, also, means through which a heat transfer liquid can be circulated to elevate the temperature of said surface; steam supply means; a heat exchanger means; means for circulating steam from said supply means and the heat transfer liquid in heat transfer relationship through said heat exchanger means to heat the heat transfer liquid; and means for thereafter circulating said heat transfer liquid to and through the web drying means.

2. A papermaking installation in accord with claim 1, in which the drying means through which the heat transfer liquid is circulated comprises a series of rotary, equitemp dryers.

3. A papermaking installation in accord with claim 1, which has means for condensing blow-through steam from the heat exchanger means and for returning the condensate to the steam supply means.

* * * * *